US005103599A

United States Patent [19]

Carlson

[11] Patent Number: 5,103,599

[45] Date of Patent: Apr. 14, 1992

[54] SUPER FLAT SANDER

[76] Inventor: Carl A. Carlson, 2839 Eddington Ave., Bensalem, Pa. 19020

[21] Appl. No.: 637,461

[22] Filed: Jan. 4, 1991

[51] Int. Cl.[5] ..... B24D 15/00

[52] U.S. Cl. ..... 51/391; 51/392; 51/382

[58] Field of Search ..... 51/382, 391, 389, 392, 51/390, 393, 241 R, 358, 170, 180, 175, 170 TL

[56] References Cited

U.S. PATENT DOCUMENTS 2,201,645 5/1940 Epner ..... 51/392 X
3,483,662 12/1969 Ames ..... 51/392
3,973,362 8/1976 Groshans ..... 51/170 R X
4,885,876 12/1989 Henke ..... 51/392 X

*Primary Examiner*—M. Rachuba
*Attorney, Agent, or Firm*—Dann, Dorfman, Herrell and Skillman

[57] ABSTRACT

A sanding tool for use on joints of wallboards or other flat surfaces. The tool may interact with other standard sanding tools or may be used independently. A flat base is provided with fasteners to secure an abrasive material and a standard sanding tool to the base. The tool provides an extra-large sanding surface and a re-enforced base for improved and more efficient sanding.

16 Claims, 1 Drawing Sheet

SUPER FLAT SANDER

FIELD OF THE INVENTION

The present invention relates to an extra large flat sander for sanding and finishing the joints of dry wallboard or gypsum wallboard making the wall appear smooth and continuous. The present invention helps abbreviate the repetitive and time-consuming process of applying adhesive and sanding the joint until the interior wall appears smooth and continuous.

BACKGROUND OF THE INVENTION

Dry wallboards and gypsum wallboards are the two most common materials used in the construction industry for constructing the interior walls of houses and buildings. These wallboards are supplied in standard sheets four feet wide by eight to sixteen feet tall. The wallboards are nailed, screwed or otherwise fastened to studs to form the interior wall.

At the boundry of two adjoining wallboards is a seem or joint. To fill this joint, the prior art, U.S. Pat. No. 4,592,797, provides a tool for applying tape and adhesive to the wallboard joint wherein the adhesive or joint compound is first laid down over the joint and tape is applied over the adhesive. Once the adhesive and tape have dried, the joint is sanded until smooth. Very often the interior wall does not appear smooth and continuous after one application of adhesive, thus requiring at least a second application of adhesive on the joint and subsequent sanding until the interior wall appears smooth and continuous.

Conventional sanders are provided in the prior art for sanding wallboard joints as well as nail holes, angles, and cornerbeads on the wallboards. A typical conventional sander comprises a flat cast-aluminum base, approximately 9"×3" with a padded sanding side, a pivotally-mounted connector for attaching a handle to the base, and fasteners for attaching a sheet of sandpaper to the base. Conventional sanders are effective for sanding nail holes, angles, and cornerbeads on the interior wall but are not as effective for sanding wallboard joints. Thus, to achieve an interior wall that appears smooth and continuous using a conventional flat sander, the process of applying tape and adhesive, and sanding has had to be repeated several times until an acceptable appearance is achieved. Even after several applications of adhesive and subsequent sanding, high lows, crowned seams, hollow seams, cross buts, and shadows often appear on the joints after painting.

SUMMARY OF THE INVENTION

The present invention provides a more efficient alternative to conventional sanders and produces a finished interior wall that appears smooth and continuous while using less effort than conventional sanders. One embodiment of the present invention is designed to coact with conventional sanders which are acceptable for use on nail holes, angles, and cornerbeads, but are not as effective as the present invention for use on wallboard joints themselves.

More specifically, the present invention provides an oversized sander for use primarily on the joints of dry wallboards. The sander base has a sanding side on which an abrasive material is fastened for sanding and smoothing an interior wall, and an opposite fastening side on which support members, fastening means and locking means are located. The sander is made of an extremely rigid material and has at least one support member fixed to the base for providing added rigidity to and preventing warping of the sander base. The sanding area of the sander base is up to four times larger than a conventional sander. The sanding side of the base preferably is covered with a thin layer of resilient material. A fastening mechanism is provided on the fastening side of the base for securing a flexible sheet carrying an abrasive material to the base. One embodiment of the invention also has a locking mechanism on the fastening side of the base for locking a conventional sander to the sander base. This embodiment quickly engages and disengages with a conventional sander.

In use, the present invention provides a much more efficient tool for sanding wallboard joints, and produces a finished interior wall that appears much smoother and more continuous than a wall finished with a conventional sander. The present invention covers the entire seam at once and automatically finds the highest area of the drywall seam. The super flat sander produces superior results quicker and more easily than a conventional sander since the super flat sander has approximately four times the sanding area as a conventional sander.

BRIEF DESCRIPTION OF THE DRAWINGS

A preferred structure and examples of the invention are more fully set forth hereinafter with reference to the accompanying drawings, wherein.

DESCRIPTION OF THE PREFERRED EMBODIMENTS

Figure 1:
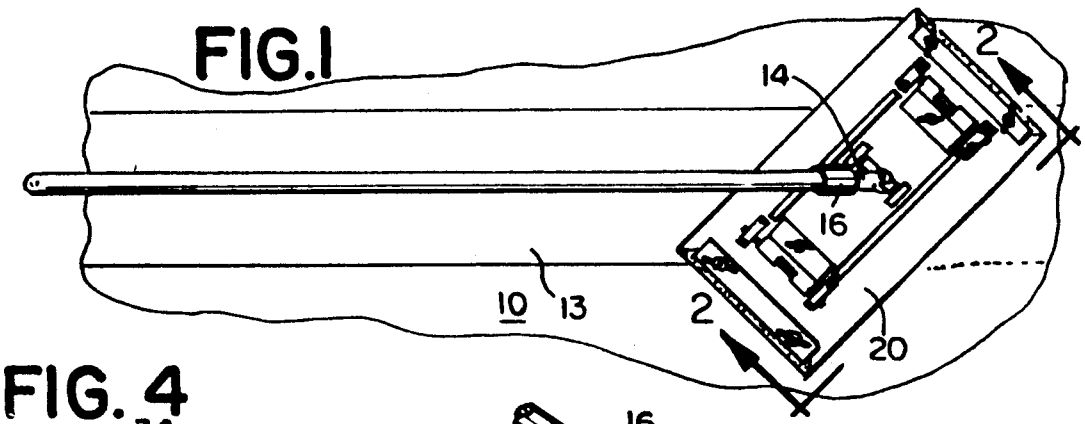
FIG. 1 is a perspective view of a sander tool embodying the invention being used on a joint of a wall.

Referring now in greater detail to the drawings, the invention is designed for use in the construction industry for finishing and sanding the joints of dry wallboards or gypsum wallboards to give the appearance of a smooth and continuous interior wall. The sander base is designed to receive and adapt with a standard sander to improve its efficiency and results. The process of converting and adapting the standard sander with the present invention is very quick, requiring less than 30 seconds assembly time, and easy, requiring no additional tools for assembly. FIG. 1 shows a perspective view of the sanding tool being used on a wall 10 with a joint covered by adhesive (not shown) and tape 13. The sander is shown being used on a slight angle for best results.

Figure 2:
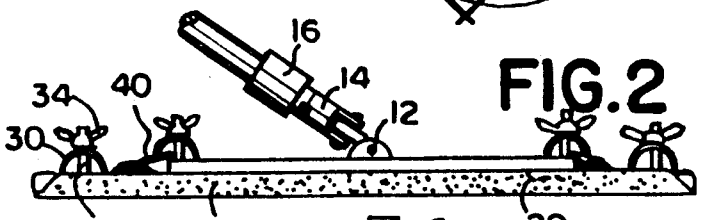
FIG. 2 is a side elevational view of the sanding tool of FIG. 1.

FIG. 2 shows a side view of one embodiment of the present invention. The base has a rectangular shape with a length and a width. The base of the sander 20 is made of an extremely rigid material. A very rigid plastic material, such as phenolic resin, or cast aluminum are acceptable materials. The base must be very rigid to maintain its flat base plane profile. Even slight bending of the sander base would cause uneven sanding.

It is also important that the length of the sander be at least as long as the adhesive and tape applied over the standard joint. The adhesive and tape applied to a standard joint is typically 8–10 inches. As shown in FIG. 1, the sander base 20 easily sands the entire width of the tape with one vertical pass of the sander. For example, it is common in the industry to apply a ten-inch wide tape over the standard joint between two dry wallboards. A conventional sander is approximately nine inches long and three inches wide. Thus, the conventional sander cannot evenly sand the entire width of the joint in one pass of the sander. A preferred embodiment of the sander base of the present invention has a length of approximately 15 inches long and a width of approximately seven inches wide. The sander base of the present invention can easily cover the entire width of any wallboard joint with one pass of the sander.

Since the sander base is much larger, having as much as four times the sanding area than a conventional sander, it is subject to greater bending stresses than a conventional sander. The sander base must, therefore, be extremely rigid to retain a flat base profile. This rigidity is maintained by a choice of rigid base materials which may include phenolic resin from standard sheet stock or cast aluminum. Adding to the rigidity of the sander base are support members 22, 22 fixed along the length of the sander base on the sanding side of the base.

Figure 3:
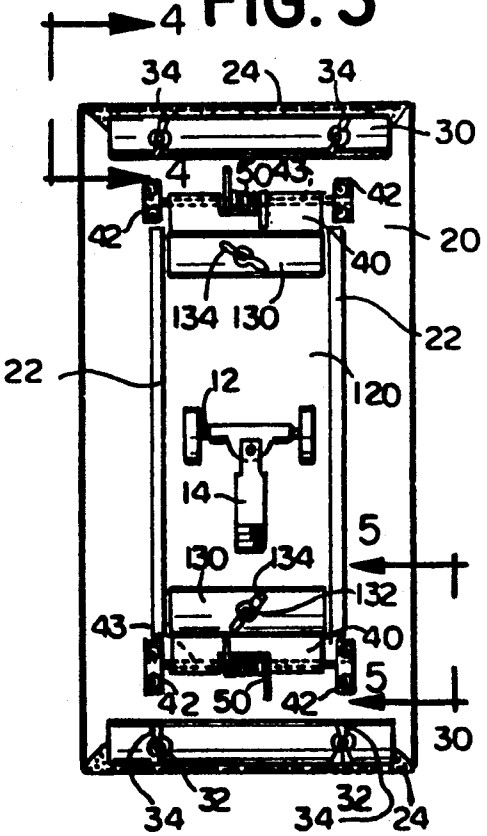
FIG. 3 is a top plan view of the sanding tool.

The support members can be made of the same material as the sander base or some other rigid material. In FIG. 3, two support members 22, 22 are shown adhesively fixed to the fastening side 20*a* of the sander base 20. The support members 22, 22, as well as the base 20, are made of standard stock phenolic resin. Alternatively, the sander base can be made in an injection mold with the support members being formed in the mold. The support members are approximately 8.5 inches long and run lengthwise along the middle 50 percent of the sander base where bending stresses are highest. Both the sander base 20 and the support members 22, 22 are approximately ¼ inch in thickness for appropriate rigidity.

The sanding side 20*b* of the sander base is covered with a resilient material. This causes the sander base to absorb moisture at different rates on one side than the other side which causes warping. The support members 22 help prevent warping of the sander base by adding to the thickness and rigidity of the sander base.

Figure 4:
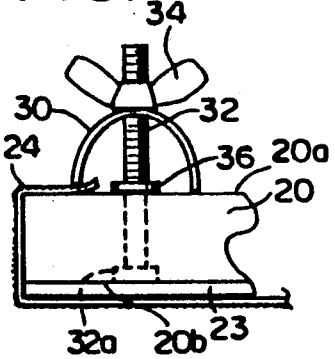
FIG. 4 is an enlarged partial view taken along line 4—4 of FIG. 3.

Referring to FIG. 2, two fasteners 30 are fixed to the sander base for fastening a sheet of sandpaper 24 to the sanding side of the sander base. Other types of abrasive material similarly may be fastened to the sander base by the fasteners. Referring to FIG. 4, one embodiment of tightening and locking means for impinging on a clamping member is shown as a bolt 32 mounted to the sander base through the sanding side 20*b* with the bolt head 32*a* flush with the sanding side 20*b* of the base 20. A nut 36 fastens the bolt to and impinges on the sander base with the remainder of the bolt protruding outwardly from the fastening side 20*a* of the sander base 20. A clamping member 30 has holes in it to receive the bolts 32 which are threaded to receive a wing nut 34 to tighten and fasten the clamping member 30 against the sandpaper sheet 24 and clamps the sandpaper sheet between the clamping member 30 and the sander base 20. In this embodiment, the clamping member comprises a segment of conduit split along its length.

Locking means are also provided on the sander base for locking the sander base to and adding rigidity to a standard sander. As seen in FIGS. 3 and 4, a hinged plate 40 is mounted on hinges 42 located on the fastening side of the sander base. In the embodiments shown in FIGS. 3 and 4, the hinge member comprises a thin metal hinge plate connected to a hinge pin 43. The hinge pin 43 rotates in two hinges 42 mounted to the sander base by bolts 44 with bolt heads 44*a* flush with the sanding side 20*b* of the base so as to not interfere with the flat sanding surface. Nuts 46 are threaded to receive the bolts 44 and tighten down and lock the hinges 42 to the fastening side 20*a* of the sander base 20. Alternatively, hinge plate 40 could comprise a flexible material either bolted or adhesively fastened to the sander base.

In one embodiment shown in FIG. 3, the hinge plate 40 coacts with the sandpaper clamping member 130 of the standard sander 130. The hinge plate 40 inserts into and is impinged by the sandpaper clamping member 130. The hinge plate tab 40 is locked between the conventional sander base 120 and the conventional sandpaper clamping member 130 when the clamping member 130 is in tight communication with the hinge plate.

Figure 5:
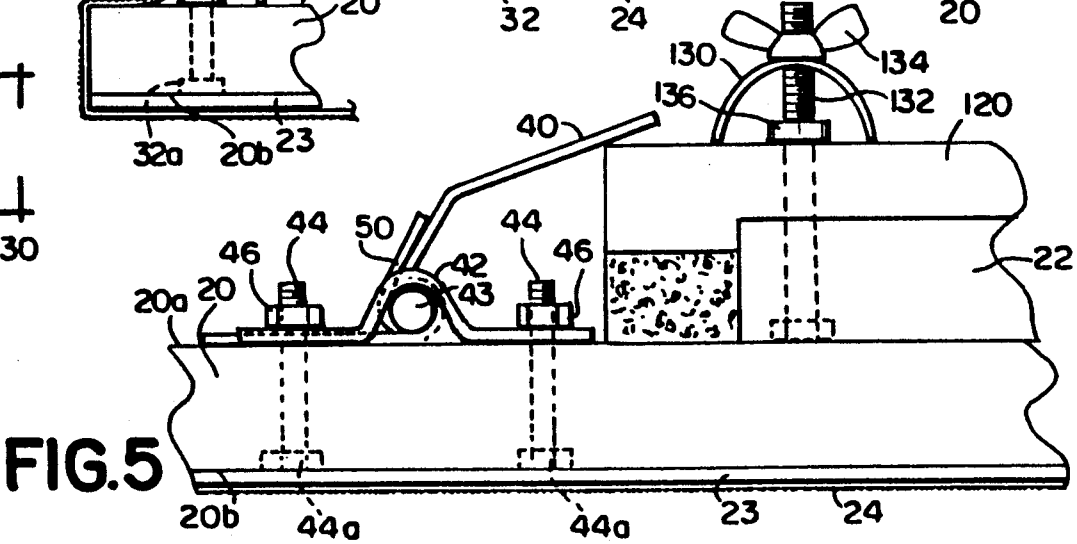
FIG. 5 is an enlarged partial view taken along line 5—5 of FIG. 3.

Another embodiment of this invention is shown in FIG. 5 in which a spring-loaded hinge plate impinges directly on the conventional sandpaper clamping member 130. In this embodiment, a spring is wound around the hinge pin causing the hinge plate to rotate in the direction of the sander base centroid. A conventional sander is locked to the sander base by rotating the hinge plate away from the centroid of the sander base, placing the conventional sander on the sander base, and releasing the spring-loaded hinge plate. The hinge plate locks the two sander bases together when the hinge plate is released and impinges directly on the conventional sandpaper clamping member 130. In this alternative embodiment, it is unnecessary to unfasten the conventional sandpaper clamping member 130 to adapt the sander base.

Locking a conventional sander to the sander base 20 also provides additional support and added rigidity to the base. Since the conventional sander is locked in close communication with the sander base 20, it serves the same functions as the support members 22, i.e., adding rigidity and support, and preventing warping of the sander base 20, in addition to providing a connecting means to attach a handle to the tool.

Therefore, as seen in FIG. 3, support members 22 also serve the function of side-stops which define the width of a receptacle for receiving and positioning the conventional sander on the sander base 20. The support members position the conventional sander in the center of the base 20 before locking the two sanders together. The support members 22 also prevent movement in the sander base plane and assist the locking means in holding the two sander bases together whereby the locking means act as end-stops and define the length of the receptacle.

A thin layer of resilient material 23 covers the sanding side 22*b* of the sander base 20. The material shown in FIGS. 4 and 5 is a thin layer of rubber approximately 1/16" thick and is adhesively attached to the sanding side 20*b* of the sander base. The resilient material also provides a non-slip surface between the sandpaper sheet and the sander base. The adhesive material also improves the sander's performance by providing a padded and resilient backing for the sandpaper.

While considerable emphasis has been placed herein on a sanding tool designed for integration with a conventional sander, it should be appreciated that the desired increase in efficiency and resultant wall smoothness may be obtained with an independent sander tool. The first embodiment of the present invention is designed to interact with a conventional sander for practical and economic reasons. While finishing the interior walls of a room, the cornerbeads, nail holes, and angles also require sanding in addition to the wallboard joints. The first embodiment of the present invention permits quick interchange for workers wishing to use the conventional sander on the cornerbeads, nail holes, and angles of the interior wall, while using this invention for the wallboard joints. However, for workers wishing to use only one tool, another embodiment of the present invention provides for a sander base with its own connector means for connecting a handle to the sander base 20.

In a second embodiment of the present invention, neither hinge plates 40 nor any locking means are necessary. This embodiment requires a sandpaper fastening means and a connecting means on the sander base 20. This embodiment functions independent of a conventional sander.

While particular embodiments of the present invention have been herein illustrated and described, it is not intended to limit the invention to such disclosures, but changes and modifications may be made therein and thereto within the scope of the following claims.

I claim:

1. A tool for sanding joints of wallboards, said tool being adapted to coact and interlock with a conventional sander having a conventional sander base of a predetermined length and width, the conventional sander base providing a sanding surface, said tool comprising:

a tool base having (a) a receptacle for receiving the conventional sander base, said receptacle having a length and width generally corresponding to the length and width of said conventional sander base, the receptacle positioning the conventional sander base on said tool base and restricting movement of said conventional sander base relative to the tool base, and (b) a generally flat sanding area having a predetermined size which is larger than the sanding surface of the conventional sander base;

a fastener on said tool base for fastening an abrasive material at the sanding area of said tool base; and releasable locking means on said tool base for releasably locking the conventional sander to said tool base with the conventional sander base positioned within the receptacle of the tool base.

2. A tool for sanding joints of wallboards according to claim 1 wherein the generally flat sanding area of said tool base is between three to four times larger than the conventional sanding surface.

3. A tool for sanding joints of wallboards according to claim 1 comprising a rigid support member fixed to said tool base for adding rigidity and preventing warping of said tool base.

4. A tool for sanding joints of wallboards according to claim 3 wherein said support member comprises two rigid strips located on said tool base generally parallel to one another.

5. A tool of sanding joints of wallboards according to claim 1 wherein said sanding surface of the conventional sander tightly engages the tool base within the receptacle to provide additional support and rigidity to the tool base.

6. A tool for sanding joints of wallboards according to claim 1 wherein said receptacle comprises end-stops positioned to engage each end of the conventional sander base to restrict longitudinal movement of the conventional sander base relative to the tool base and side-stops positioned to engage each side of the conventional sander base to restrict transverse movement of the conventional sander base relative to the tool base.

7. A tool for sanding joints of wallboards according to claim 6 wherein said side-stops comprise two rigid strips on the tool base oriented generally parallel to one another and spaced apart form each other a selected distance which is at least the width of the conventional sander base.

8. A tool for sanding joints of wallboards according to claim 6 wherein said fastener comprises said end-stops, said end-stops being located form each other a distance which is at least the length of the conventional sander base.

9. A tool for sanding joints of wallboards according to claim 1 wherein said locking means comprises a hinge plate mounted on said tool base, said hinge plate being spring-loaded to engage and hold said conventional base.

10. A tool for sanding joints of wallboards according to claim 1 wherein said conventional base of the conventional sander includes a releasable clamping mechanism for holding sandpaper in position on the conventional sanding surface and wherein said locking means coacts with the releasable clamping mechanism to hold the tool in position on the conventional base, said locking means including a hinge plate mounted on said tool base so that the clamping mechanism clamps on to the hinge plate to releasably clamp the conventional sander and said tool base together.

11. A tool for sanding joints of wallboard according to claim 1 wherein the generally flat sanding area of the tool base has a predetermined dimension which is at least as long as the width of selected joint tape for said joint to be sanded by the tool.

12. A tool for sanding joints of wallboards, said tool being adapted to coact and interlock with a conventional sander having a conventional sander base of a predetermined length and width, the conventional sander base providing a sanding surface, said tool comprising:

a tool base having (a) a surface generally conforming to the shape for the sanding surface of the conventional sander base for engaging the sanding surface of the conventional sander in surface-to-surface contact, and (b) a generally flat sanding area having a predetermined size which is larger than the sanding surface of the conventional sander base;

a fastener on said tool base for fastening an abrasive material at the sanding area of said tool base; and releasable locking means on said tool base for releasably locking the tool base to the conventional sander base.

13. A tool for sanding joints of wallboard according to claim 12 wherein the generally flat sanding area of the tool base has a predetermined dimension which is at least as long as the width of selected joint tape for said joint to be sanded by the tool.

14. A tool for sanding joints of wallboards according to claim 12 wherein the generally flat sanding area of said tool base is between three to four times larger than the conventional sanding surface.

15. A tool for sanding joints of wallboards according to claim 12 wherein said locking means comprises a hinge plate mounted on said tool base, said hinge plate being spring-loaded to engage and hold said conventional base.

16. A tool for sanding joints of wallboards according to claim 12 wherein said conventional base of the conventional sander includes a releasable clamping mechanism for holding sandpaper in position on the conventional sanding surface and wherein said locking means coacts with the releasable clamping mechanism to hold the tool in position on the conventional base, said locking means including a hinge plate mounted on said tool base so that the clamping mechanism clamps onto the hinge plate to releasably clamp the conventional sander and said tool base together.

* * * * *

UNITED STATES PATENT AND TRADEMARK OFFICE

CERTIFICATE OF CORRECTION

PATENT NO. : 5,103,599

DATED : April 14, 1992

INVENTOR(S) : Carl A. Carlson

It is certified that error appears in the above-identified patent and that said Letters Patent is hereby corrected as shown below:

Col. 5, line 60, claim 5, "of" (1st occurrence) should read --for--.

Claim 7, Column 6, line 8, "form" should read --from--.

Claim 8, Column 6, line 13, "form" should read --from--.

Signed and Sealed this

Thirteenth Day of July, 1993

*Attest:*

Michael K. Kirk

MICHAEL K. KIRK

*Attesting Officer*

*Acting Commissioner of Patents and Trademarks*